United States Patent [19]

Ginzburg et al.

[11] Patent Number: 4,630,352

[45] Date of Patent: Dec. 23, 1986

[54] CONTINUOUS ROLLING METHOD AND APPARATUS

[75] Inventors: Vladimir B. Ginzburg; George W. Tippins, both of Pittsburgh, Pa.

[73] Assignee: Tippins Machinery Company, Inc., Pittsburgh, Pa.

[21] Appl. No.: 646,956

[22] Filed: Sep. 4, 1984

[51] Int. Cl.[4] ..... B21B 1/46; B21B 41/00; B22D 11/12

[52] U.S. Cl. ..... 29/527.7; 164/417; 72/227

[58] Field of Search ..... 29/527.7; 72/202, 229, 72/200, 227; 164/417, 476

[56] References Cited

U.S. PATENT DOCUMENTS

| | | | |
|---|---|---|---|
| 4,005,744 | 2/1977 | Cofer et al. | 164/417 |
| 4,232,727 | 11/1980 | Bower et al. | 164/417 |
| 4,384,468 | 5/1983 | Ginzburg | 72/227 |
| 4,430,874 | 2/1984 | Tippins et al. | 72/202 |

*Primary Examiner*—Howard N. Goldberg
*Assistant Examiner*—Steven Nichols
*Attorney, Agent, or Firm*—Webb, Burden, Robinson & Webb

[57] ABSTRACT

A method and apparatus for rolling strip in line with a continuous caster is disclosed. A slab capable of being coiled say 1.5 inches or less, is passed through an in-line furnace to homogenize temperature and is thereafter coiled in one of two vertically aligned coilers in either side of the pass line. The slab is then payed off into a rolling mill while a subsequent slab is coiled in the other of the two coiler furnaces.

4 Claims, 1 Drawing Figure

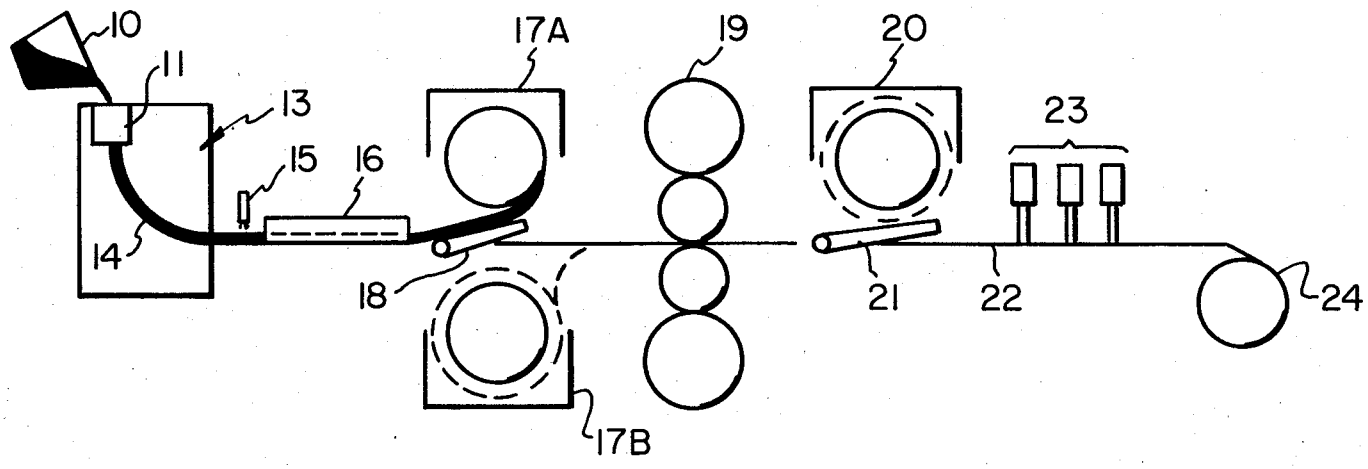
10
11
13
14
15
16
17A
17B
18
19
20
21
22
23
24

CONTINUOUS ROLLING METHOD AND APPARATUS

BACKGROUND

There has been a trend in recent years to establish so-called "mini mills" or "mini-midi mills". These are mills that typically produce 100,000 to 1,000,000 tons of steel per year as specialized products. These mills have been integrated with continuous casters for casting small billets, bars, and rods. However, the integration of casters and mini mills has not extended to the reduction of slabs to strip thicknesses because of the large capital investment required for floor space and rolling equipment.

This invention relates to an integrated process for the casting and rolling of slabs to form strip and/or sheet. It has particular application to the small steel mill where space is limited. In this process, rolling may take place in a reversing mill rather than a continuous or semi-continuous hot strip mill. It involves the use of continuously cast thin slabs, say on the order of 1.5 inches thick or less. Heretofore, continuous casting has been considered primarily for casting of thick slabs, say 8 inches thick, which slabs must be processed through rolling mills including reheat furnaces, roughing and finishing trains.

In one aspect, this invention relates to unique application of coiler furnaces. The uses of coiler furnaces have been described, for example, in U.S. Pat. Nos. 2,658,741; 4,384,468; 4,430,870; and British Specifications Nos. 918,005 and 652,772.

In yet another aspect, this invention relates to the processing of continuously cast slabs that are as thin as practical, say 1.5 inches or less, as can be coiled. It has been reported that increasingly thinner sections have been cast with present capability limited to about 1 inch thickness, *Iron and Steel Engineer,* February 1984, p. 47. This article states that government sponsored research is being directed to ultimately casting strip at or near final thickness. However, in the near future, the applicants' approach to thin slab casting and hot rolling almost directly as the slab emerges from caster has much greater potential.

SUMMARY OF THE INVENTION

Briefly, according to this invention, there is provided a method of casting and rolling steel strip and/or sheet. The method comprises a first step of continuously casting a slab to a thickness capable of being coiled, say 1.5 inches or less. A second step comprises equalizing the temperature of the continuously cast slab prior to reduction. A third step comprises alternately coiling slabs in a first coiler furnace or a second coiler furnace, each of which is positioned upstream of a rolling mill. A fourth step comprises rolling the slab to strip, for example, by passing it back and forth through a reversing mill between one of the upstream coiler furnaces and a coiler furnace downstream of the reversing mill. A final step comprises recovering coiled strip.

According to a preferred method, the two upstream coiler furnaces are in vertical alignment and while strip is being rolled by passing back and forth between the first coiler furnace upstream of the reversing mill and the downstream coiler furnace, a continuously cast slab is being taken up on the second coiler furnace upstream of the reversing mill. According to another preferred embodiment, a step is provided for passing the strip, which has been hot rolled to the desired gauge, over a roll-out table where cooling jets bear upon it and then passing the strip to a final coiler.

Also, according to this invention there is provided a plant for rolling steel strip and/or sheet. The plant comprises an apparatus for melting steel and apparatus for continuous casting slabs having a thickness capable of being coiled, say on the order of 1.5 inches or less. The plant may include a furnace for receiving the cast slabs directly from the caster to reduce the difference in temperature from the interior to the faces of the slabs. The plant comprises two coiler furnaces (preferably vertically aligned) downstream of said caster (and furnace, if present) and upstream of a rolling mill for alternately receiving and coiling slab delivered from said furnace and finally the plant comprises a rolling mill to roll slabs to strip by receiving slabs first from one and then from the other coiler furnace. Preferably, the processing rate (tons per hour) of the rolling mill is slightly greater than the processing rate of the caster.

According to a preferred embodiment, the plant comprises a reversing mill and a downstream coiler furnace so that slabs can be passed back and forth through the reversing mill from one coiler furnace to another.

DESCRIPTION OF THE DRAWINGS

Further features and other objects and advantages of the invention will become clear from the following detailed description made with reference to the drawing, FIG. 1, which is a schematic of a plant for continuously casting and rolling slabs to strip.

DESCRIPTION OF THE PREFERRED EMBODIMENTS

Referring now to FIG. 1, hot metal is transferred from the furnace, for example, an electric furnace (not shown) by transfer ladle 10 to the tundish 11 of a continuous casting apparatus, caster 13. The steel solidifies into a continuous slab as it passes through the water cooled curved mold 14. As the steel slab passes through the mold, the direction is changed from vertical to horizontal, although horizontal casters are known and can also be employed. The mold is sized so that the slabs emerging from the mold have a thickness of about 1.5 inches or less and a width of up to 72 inches. The specific slab referred to hereinafter is 1.5 inches×50 inches×157 feet long. The slab is cut to length by slab cutting torch 15 when it reaches the desired length. The continuous slab emerges at an approximate rate of 12 feet per minute (approximately 90 U.S. tons per hour). The details of the continuous slab caster are known and form no part of this invention.

The continuous slab immediately passes into a furnace 16 which is for the purpose of reducing the temperature difference between the interior and faces of the slabs, i.e. homogenizing the slab temperature. The furnace 16 (illustrated as a tunnel furnace) adds little heat to the slab but allows equalization of temperature throughout the slab. The temperature of the slab emerging from the furnace 16 is approximately 1900° F. (1090° C.).

The slab is then taken up by one of two coiler furnaces 17*a* and 17*b*. Each coiler is capable of receiving material from the caster and paying off in the opposite direction. Guide table 18 directs the slab to one or the other of these coiler furnaces. Preferably, the furnaces are vertically arranged one above the other, above and below the elevation at which the slab emerges from the furnace 16. The coiler furnaces generally include burners to maintain the appropriate temperature. This temperature is required both for that of the slab and subsequent workpiece being coiled and decoiled and for the coiler mandrel which must be at a temperature near that of the incoming steel to prevent thermal shock. The details of the construction of the coiler furnace are known and form no part of this invention.

A four high hot reversing mill 19 is arranged downstream of the coiler furnaces 17*a* and 17*b* for receiving the slab from either. Beyond the reversing mill is another coiler furnace 20. The distance between the mill and the coiler furnaces on each side is approximately 23 feet.

Following downstream coiler furnace 20 is roll-out table 22 over which nozzles 23 are positioned for spraying cooling fluid upon the strip to lower its temperature to the desired coiling temperature. Downcoiler(s) 24 receive the finished strip although shears may be alternately employed where a sheet product rather than a hot strip band is required.

The vertical coilers allow the rolling operation to be synchronized with the casting operation. Since the slab thickness is small in comparison to standard slabs, the productivity in terms of tons/hr. is also small. For this reason a single hot reversing mill can presently handle the projected tonnage. It will be recognized that additional rolling stands can be employed upstream and/or downstream of the downstream coiler 20 depending on the tonnage capability of the caster or the finished product needs, e.g., an additional stand for a particular roll surface. The coiler furnaces also maintain the necessary heat so that an acceptable temperature drop is maintained during the various passes. While one vertical coiler is receiving the slab from the caster, the other coiler is working in conjunction with the mill and the downstream coiler to reduce the strip in back and forth passes between the coilers and through the mill.

A computer simulation of a seven-pass cycle on a single hot reversing mill for reducing a low carbon steel slab 1.5 inches×50 inches×157 feet to a 20 ton coil (800 PIW) 0.1 inch thick may be summarized in the following Table 1:

The 494 seconds for rolling compare favorably with the time to coil the slab, namely 785 seconds at 12 feet per minute.

The equalizing furnace and its function may be replaced by the coiler furnaces. In other words, the temperature equalization may be achieved without the need for a separate furnace installation such as the tunnel furnace illustrated.

Having thus defined the invention in the particularity and detail as required by the Patent Laws, what is desired protected by Letters Patent is set forth in the following claims.

I claim:

1. A method of casting metal slabs and rolling said metal slabs into strip and/or sheet in line comprising the sequential steps of:

(a) continuously casting a continuous steel slab having a thickness capable of being coiled;

(b) equalizing the temperature of the forward section of said continuous slab to provide a substantially homogeneous temperature therein;

(c) cutting off the forward section from said continuous slab to form an individual slab having the desired length;

(d) coiling alternative individual slabs in a first coiler furnace and in a second coiler furnace vertically disposed relative to said first coiler furnace and located downstream of a continuous caster and upstream of a rolling mill; and (e) rolling each individual slab to strip by paying off said individual slab through said rolling mill from one of said vertically disposed coiler furnaces while taking up the following individual slab on the other of said vertically disposed coiler furnaces so that the speed of the continuous casting is coordinated with the rolling speed to provide a substantially uninterrupted method of continuous casting and rolling.

2. The method according to claim 1 wherein the step for rolling slabs to strip comprises passing a slab back and forth through a reversing mill between one of said first and second vertically disposed coiler furnaces and another coiler furnace downstream of said reversing mill.

3. The method according to claim 1 including casting said slab to a thickness of about 1.5 inches or less.

4. The method according to claim 1, said metal being steel.

* * * * *

TABLE I

| | | | | | Rolling Schedule | | | | |
|---|---|---|---|---|---|---|---|---|---|
| | Exit Gauge | | Entry Temp. | Exit Temp. | Mill Speed (FPM) | | Roll Time | Delay Time | Elapse Time |
| Pass | (inches) | % Red. | °F. | °F. | Thread | Roll | (sec.) | (sec.) | (sec.) |
| FCE | 1.50 | 0 | 1900 | 1900 | 0.0 | 0.0 | 0.0 | 0.0 | 0.0 |
| 1 | .870 | 42 | 1862 | 1873 | 500.0 | 550.0 | 30.73 | 5 | 35.73 |
| 2 | .530 | 39.1 | 1851 | 1859 | 500.0 | 650.0 | 43.16 | 5 | 83.89 |
| 3 | .333 | 37.2 | 1830 | 1835 | 500.0 | 750.0 | 59.48 | 5 | 148.37 |
| 4 | .220 | 33.9 | 1801 | 1803 | 500.0 | 950.0 | 71.70 | 5 | 225.06 |
| 5 | .158 | 28.2 | 1767 | 1764 | 500.0 | 1200.0 | 79.78 | 5 | 309.84 |
| 6 | .120 | 24.1 | 1729 | 1724 | 500.0 | 1500.0 | 84.91 | 5 | 399.76 |
| 7 | .100 | 16.7 | 1690 | 1672 | 500.0 | 1500.0 | 94.23 | 0.0 | 493.98 |